US005186264A

United States Patent [19]

du Chaffaut

[11] Patent Number: 5,186,264

[45] Date of Patent: Feb. 16, 1993

[54] DEVICE FOR GUIDING A DRILLING TOOL INTO A WELL AND FOR EXERTING THEREON A HYDRAULIC FORCE

[75] Inventor: Benhoist A. du Chaffaut, Versailles, France

[73] Assignee: Institut Francais du Petrole, Rueil-Malmaison, France

[21] Appl. No.: 655,420

[22] PCT Filed: Jun. 25, 1990

[86] PCT No.: PCT/FR90/00465

§ 371 Date: Apr. 26, 1991

§ 102(e) Date: Apr. 26, 1991

[87] PCT Pub. No.: WO91/00410

PCT Pub. Date: Jan. 10, 1991

[30] Foreign Application Priority Data

Jun. 26, 1989 [FR] France ..... 89 08588

[51] Int. Cl.[5] ..... E21B 4/18; E21B 4/20; E21B 7/08; E21B 44/00

[52] U.S. Cl. ..... 175/27; 175/94; 175/99; 175/38; 175/230; 175/325.3; 175/76

[58] Field of Search ..... 175/27, 230, 325.3, 175/321, 93, 94, 99, 38, 122, 73, 77

[56] References Cited

U.S. PATENT DOCUMENTS

| | | | |
|---|---|---|---|
| 2,316,409 | 4/1943 | Downing | 175/73 |
| 2,891,769 | 6/1959 | Page | 175/76 |
| 3,105,561 | 10/1963 | Kellner | 175/230 |
| 3,126,971 | 3/1964 | Kellner et al. | 175/230 |
| 3,138,214 | 6/1964 | Bridwell | 175/230 |
| 3,180,437 | 4/1965 | Kellner et al. | 175/230 |
| 3,225,843 | 12/1965 | Ortloff et al. | 175/93 |
| 3,978,930 | 9/1976 | Schroeder | 175/230 X |
| 4,284,154 | 8/1981 | England | 175/325 |
| 4,307,786 | 12/1981 | Evans | 175/231 |
| 4,615,401 | 10/1986 | Garrett | 175/230 |

FOREIGN PATENT DOCUMENTS 3103336 8/1982 Fed. Rep. of Germany .

*Primary Examiner*—Stephen J. Novosad
*Attorney, Agent, or Firm*—Antonelli, Terry, Stout & Kraus

[57] ABSTRACT

A device for guiding a drilling tool into a well and for exerting a hydraulic force on the drilling tool includes a tubular body and an outer sleeve rotating about the body and longitudinally displaceable with respect to the body. Also, the device includes radially displaceable pistons, in an extension position, that come into anchoring engagement with the wall of the well and immobilize the external sleeve, as well as a jack to displace the body and the drilling tool integral therewith with respect to the external sleeve and to exert a pushing force onto the tool. Hydraulic circuits and appropriate control assembly are also provided for controlling the execution of a series of successive cycles of anchoring of the external sleeve in the well and of displacement of the drilling tool with respect to the external sleeve.

14 Claims, 4 Drawing Sheets

DEVICE FOR GUIDING A DRILLING TOOL INTO A WELL AND FOR EXERTING THEREON A HYDRAULIC FORCE

The present invention relates to a device provided in a rotary drilling system which connects it to a surface facility a drilling tool to guide the latter in a well and exert a hydraulic force thereon in order to move it along the well.

Wells of the petroleum type are usually drilled by means of a drill bit located at the bottom end of a string of hollow pipes (drilling system). The operator uses a brake to place the system partially on the bottom of the hole such that the lower part of the drill string is compressed, and he simultaneously rotates the drill string by means of a rotary table.

An improvement on this method appeared with the use of downhole rotating motors which limit power losses caused by friction of the pipes against the well walls, and which allow better control of any deviations by allowing bent connectors to be installed in the non-rotating part of the string.

However, although rotation of the drill bit is improved in this way, bottom compression of the lower part of the string, called "tool weight", is not always well controlled from the surface.

The appearance on the market of downhole sensors (such as strain gauges, accelerometers, recorders, etc.) revealed extremely vigorous dynamic behavior at the bottom of the system: tool bouncing, temporary jamming, etc. These operating modes usually waste mechanical power and cause excess equipment wear as well as, sometimes, breakage of the drill string or bit, requiring costly retrieval operations.

Some types of equipment such as lengthwise-vibration dampers and stabilizers have been developed in the attempt to control these dynamic phenomena. In practice, stabilizers considerably increase friction and widen the hole, which fairly soon offsets the centering function sought after.

Since vibration modes are variable and poorly known, dampers are often ineffective.

These drilling drawbacks are particularly harmful in very deep and/or sharply sloping wells. Control of tool weight then fails altogether, and the torque required at the surface approaches and sometimes exceeds the capacity of the equipment. Moreover, maintenance of the desired path, achieved by modifying the weight applied and the position and diameter of the stabilizers, becomes extremely difficult and often demands lengthy, expensive corrective maneuvers.

Devices are known for applying a lengthwise force to a drilling tool and increasing its penetration capability into formations during drilling. Such devices are described for example in U.S. Pat. Nos. 3,138,214, 3,225,843, etc. They are particularly useful in slanting holes where the gravitational force component actually applied to the tool is inadequate to make it progress. Devices of this type have a body attached to the system and a sleeve provided around the body and designed to move lengthwise thereto. This sleeve is provided with anchoring pistons that are radially displaceable from a retracted position to an extended position in which they become anchored in the well wall and immobilize the sleeve in the well. The power necessary to extend the pistons is generally obtained from the circulation of drilling mud. The device also has several hydraulic jacks to move the body lengthwise relative to the sleeve when it is in the anchoring position. The power necessary for this translational movement is obtained directly by circulation of mud in the drilling system or by a pump driven by rotation of the body relative to the sleeve and designed to raise the pressure of the mud injected into the jack.

Devices of this type do drive the drilling tool forward, but they are controlled from the surface by operators who, according to information from downhole instruments, anchor the sleeve, slide the body relative to the anchored sleeve, release the sleeve, and return the device to its original position before sliding, then start a new anchoring-extension cycle.

The device according to the invention avoids the above-mentioned disadvantages by automating the operating cycles involving immobilization of the outer sleeve and movement of the drilling tool relative to the sleeve. It may be located between a drilling tool and a drilling system connecting it to a surface facility, to exert a hydraulic thrust on the drilling tool. The device has a tubular body integral with the system, a sleeve outside the tubular body able to rotate relative to said body and being longitudinally displaceable relative thereto, coupling means which can be displaced radially between a resting position in which they do not contact the wall of the well drilled by the tool, and a coupling position in which they are applied against the wall and immobilize said outer sleeve, and a hydraulic system having drive means to move said coupling means between their resting and their coupling positions, pushing means to move said body longitudinally relative to said outer sleeve in order to exert a pushing force on the drilling tool, and pumping means driven by the rotation of the body relative to said outer sleeve.

The device is characterized by the hydraulic system having hydraulic circuits isolated from the well, containing a fluid and connecting the pumping means to said pushing means and said drive means, means for varying the fluid pressure in the circuits according to the hydrostatic pressure in the well, and a control assembly which can automatically carry out a succession of cycles each consisting of immobilizing the outer sleeve relative to the well by moving coupling means into their coupling positions, moving the drilling tool relative to the outer sleeve by acting on said pushing means, from a first retracted position to a second extended position, and displacement in the reverse direction to return the outer sleeve and the body to their original positions relative to each other.

The device may include hydraulic return means to restore the outer sleeve and the body to their original positions relative to each other, and possibly second return means different from the first return means such as spring means for example.

According to one embodiment, the coupling means have several expansible elements disposed radially at the periphery of the outer sleeve and engaged respectively inside a thrust chamber, the drive means have elements displaceable in said chambers to cause their volume to vary, and the pushing means have at least one hydraulic jack, and the control assembly has a distributor which cooperates with the circuits and can switch from a first state in which the pressurized fluid delivered by the pumping means is directed to the thrust chambers and to said jack, in order to displace the expansible elements into their coupling positions with the well wall and to bring the body into the second extended position relative to said outer sleeve, and a second state in which the pressurized fluid is directed to the thrust chambers and to the jack to cause the expansible elements to return to their resting positions and move the body to its retracted position relative to the outer sleeve.

Said displaceable elements in the thrust chambers have, for example, several rods integral with an annular crown surrounding said body and displaceable in an annular chamber communicating with the pumping means by means of the control assembly.

The control assembly has, for example, control means for selectively controlling communications between said thrust chambers and the pumping means in order selectively to command displacement of the coupling means to their respective coupling positions and angularly displace the axis of the outer sleeve.

The device has, for example, several coupling means assemblies located around the outer sleeve at several separate locations along said sleeve.

According to one embodiment, the hydraulic system has hydraulic delay means allowing the expansible elements to be driven before said jack.

The hydraulic system may also include safety means to lower the pressure in the hydraulic circuits when the pumping means are not driven.

According to one embodiment, the control assembly comprises an electronic assembly connected to a surface system allowing direct transmission of commands by an operator, and said control means can be connected to the control assembly.

According to one embodiment, the means for varying the fluid pressure in the circuits as a function of hydrostatic pressure comprise a piston displaceable freely and in a fluid-tight manner in a chamber, separating the hydraulic fluid from the external environment.

The device according to the invention can be located at several points of the drilling system and also used to exert a pulling force on the drilling tool.

The invention will be well understood and its advantages will emerge clearly from reading the description illustrated by the attached figures wherein.

Figure 1A:
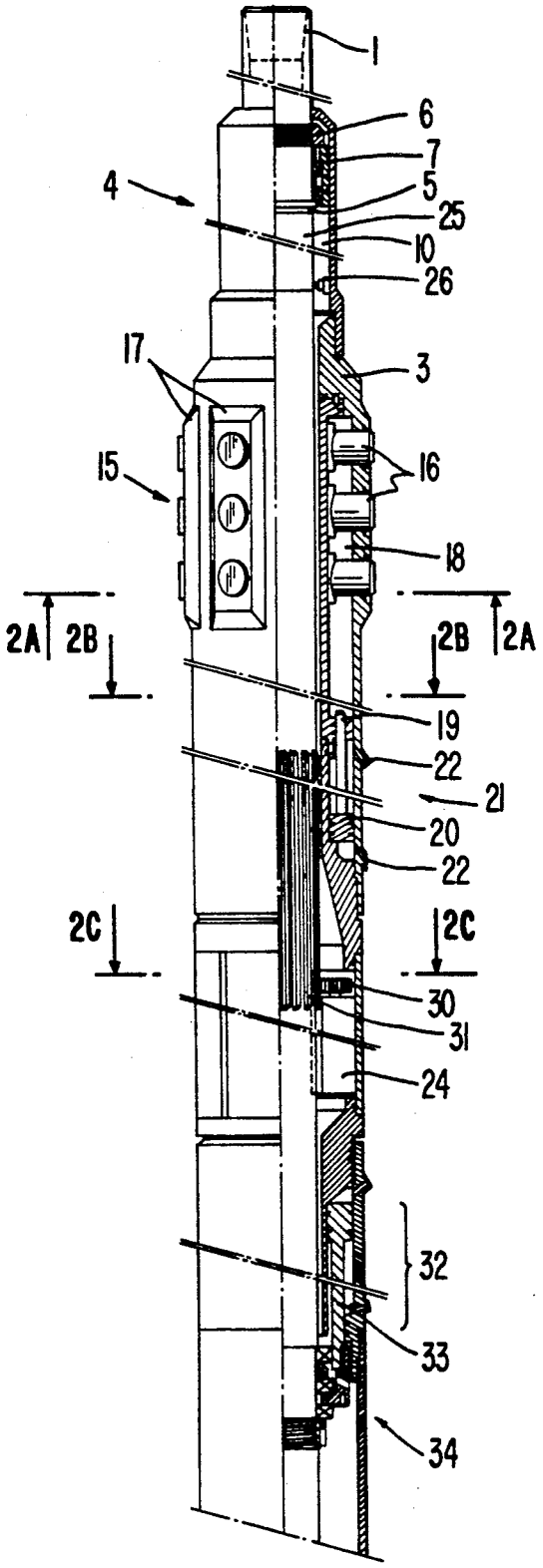
FIG. 1A shows the upper part of the device according to the invention in half cross section.

The device according to the invention has a tubular body 1 accommodated in a drill string by means of threads located at each end of this body. The lower part 1*a* of this tubular body is connected to a drill bit 2. Tubular body 1 is surrounded by a sleeve 3 which can rotate and slide relative to tubular body 1 thanks to guide means 4 disposed at each end of the device. The tubular body allows passage of interior mud usable in particular to lubricate the drilling tool.

These guide means comprise two tapered bearings translationally locked on the tubular body by a stop ring 5 and a locknut 6.

The upper cages of the bearings of guide means 4 are connected to an elongated ring 7 sliding in sleeve 3 and having gaskets 8 and a scraper ring 9 disposed at the end of ring 7 at one end of the device.

Locknut 6 has a rotating annular bearing which cooperates with a fixed annular bearing located at the end of ring 4 to provide a seal between annular space 10 located between sleeve 3 and tubular body 1, and the outside of the device. The rotating annular bearing is slidably mounted relative to the nut and sealed against the locknut. The system comprising the rotating and fixed annular bearings also has return means allowing the rotating bearing to be applied against the fixed bearing attached to the sliding ring.

Annular space 10 is filled with hydraulic fluid which is brought to a slightly higher pressure than the pressure outside the device by pressurizing means 11 comprising a sealing ring 12 sliding in an annular chamber, ring pushing means comprised of a compressed spring and an orifice effecting a hydrostatic link between ring 12 and the exterior of the device. The pressurizing means allow hydraulic fluid to leak out, particularly at the sealing means, rather than allowing material to leak in from outside the device.

Figure 4:
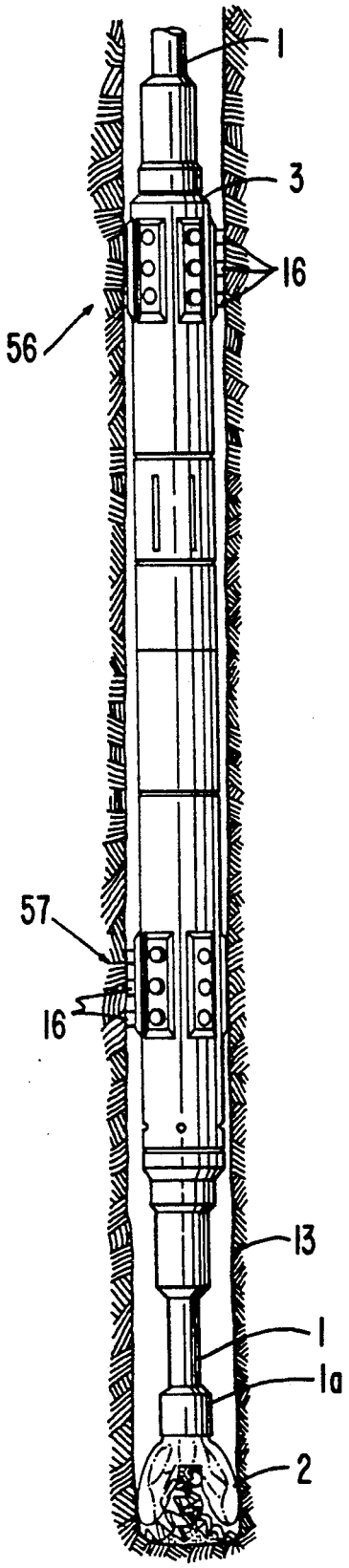
FIG. 4 illustrates the deviation between a borehole and the device according to the invention by employing adjusting means.

The expansion means 15 located at each end of the device each have six groups of expansible elements 16, regularly disposed on the circumference of sleeve 3. Expansible elements 16 are cylindrical pistons controlled hydraulically in the translational direction to position and stabilize the device in a borehole, as shown in FIG. 4. The dimensions of the expansible elements, particularly the diameter of pistons 16, is adapted to the operating hydraulic pressure, to the quality of the rock on which they bear, and to the axial force to be transmitted between the device and the borehole.

Cylindrical pistons 16 are disposed in holes in ribs 17 outside the sleeve. Ribs 17 are in the shape of skids similar to the classical stabilizers used for drilling. The travel of pistons 16 is limited by a stop located at the lower part of the piston. When pistons 16 are retracted, their tops touch the surface of the rib in which they are located. According to a preferred embodiment, the lower parts of pistons 16 belonging to a given group are located in a thrust chamber 18 with a specific volume, filled with hydraulic fluid. Each of these thrust chambers 18 has a deformable wall so that the deformation of these walls can effect the same displacement of the pistons of each of the groups. In this way, the device can be centered in the borehole or the device can be inclined relative to the borehole.

The deformable walls of each of thrust chambers 18, like the deformation element and the deformable wall, are comprised of a plunger 19.

Figure 2A:
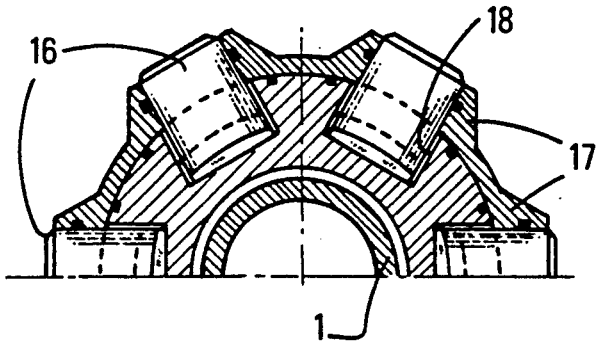
FIGS. 2A, 2B, 2C are sections A, B, C, respectively, of the device according to the invention shown in FIG. 1A.
Figure 2B:
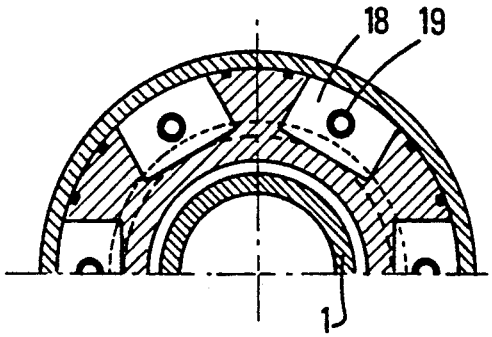
Figure 2C:
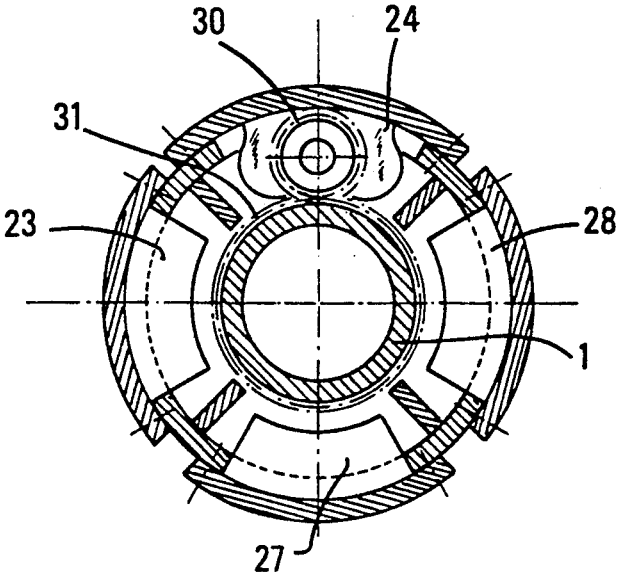

The set of plungers 19 is coupled to the round rod 20 of a double-acting hydraulic jack 21. This arrangement allows the device to be centered in the borehole by equal displacements of the plungers and expansible elements 16. The two chambers of these jacks 21 located in the upper part and in the lower part of the sleeve communicate by tapped female connectors 22 cooperating with connectors (not shown for simplification of the figure) and by control means 23 (FIG. 2C) with a hydraulic power generator 24.

Control means 23 can have, in particular, slide valves that can be driven by axial displacement of tubular body 1 relative to sleeve 3. Such an embodiment makes operation of the device according to the invention autonomous or automatic. This is of particular advantage when controlling the direction of deviation of the well is not a goal.

Hydraulic control means 23 can be either programmed or triggered by an operator at the surface. The exchange of information between the device and the operator required for triggering the control means takes place through an electric line disposed in the drill string connected to a slip ring 25 rotating under a wiper 26 connected to a multiplexing coder-decoder 27 itself connected in particular to control means 23.

Control means 23 are activated according to the position of sleeve 3 relative to tubular body 1 whose position is furnished by a measuring assembly 28. This measuring assembly has position sensors which supply information either directly or indirectly to control means 23 depending on whether the control means are programmed or non-programmed.

Figure 1B:
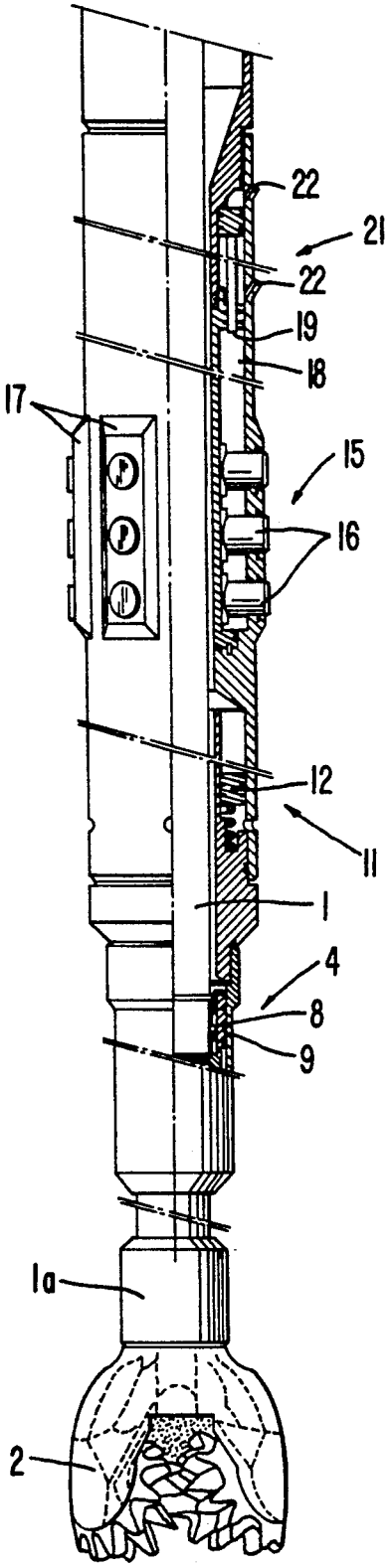
FIG. 1B shows the lower part of the device according to the invention in half cross section.

Measuring assembly 28 has position sensors designed to detect at least an initial position (FIGS. 1A and 1B) and an end position in which tubular body 1 has slid into sleeve 3.

Measuring assembly 28 also has magnetic and gravitational sensors having, for example, gyroscopes or compasses for determining the position of the axis of the device in space, as well as the position of the sleeve relative to the tubular body. Depending on whether the borehole is vertical or horizontal, these positions are determined relative to north or relative to vertical.

The information supplied by these sensors is transmitted to the surface by coder-decoder 27.

Hydraulic power generator 24 is composed of one or more pumps, of the gear or barrel type, solidly mounted in the sleeve and driven by a gear 30 cooperating with grooves 31 located in tubular body 1. It is actually driven when the rotational speed of body 1 relative to sleeve 3 is not zero.

Generator 24 has a pressure limiter that can normally be adjusted without disassembling the device and is preset according to the maximum force to be applied by the centering pistons on the borehole wall.

Generator 24 also has hydraulic pressure release means such as a leak or hydraulic circuit opening/closing system triggered by stopping the relative rotation of the body and sleeve. These release means allow, in particular, the pressure to be reduced in thrust chamber 18 and thus cause expansible elements 16 to retract when an external force is exerted on them, or when they are equipped with return means such as springs.

Generator 24 feeds, via control means 23, the chambers of a double-acting annular hydraulic jack 32 for displacing sleeve 3 relative to tubular body 1. This hydraulic jack produces a thrust that drives the drill string to the bottom of the hole when the sleeve is integral with the wall; this forward thrust is effective when the tubular body progresses from the initial position to the final position.

This hydraulic jack also returns the sleeve to its initial position after it has detached from the wall, when the tubular body and sleeve have reached the end position. The return movement of the jack can also be brought about by a spring.

This jack 32 has an annular rod 33 on which tubular body 10 is centered by means of a bearing, this rod being translationally connected to the tubular body by means of stop 34.

Figure 3:
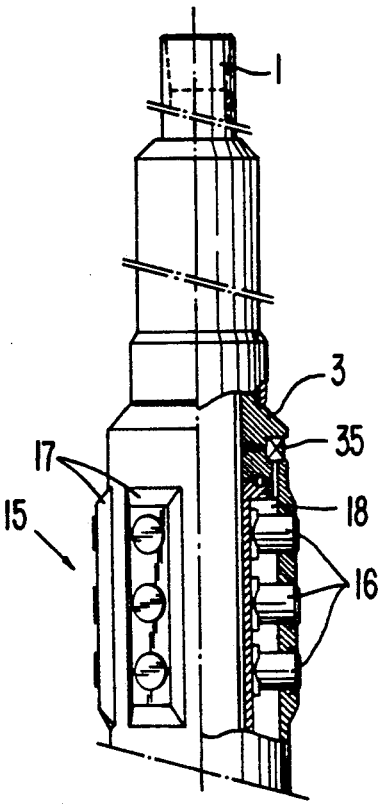
FIG. 3 is a view, partially in section, of one end of the device according to the invention having means for adjusting the volume or pressure of a thrust chamber.

FIG. 3 shows a particular embodiment of the device which allows the device to be inclined relative to the hole axis in order to produce drilling deviations, as shown in FIG. 4.

The device is equipped with solenoid valves 35 controlled by coder-decoder 27 which provide communication between thrust chambers 18 of groups of expansible elements 16 with annular space 10 between sleeve 3 and tubular body 1.

In this way, when solenoid valve 35 opens relative to one group of expansible elements 16, and when jack or jacks 21 is/are activated, elements 16 are not extended in this group of elements, while the other groups are extended. Thus, by controlling the various solenoid valves, particularly those diametrically opposite and relative to expansion means 36 and 37 located at the two ends of the device, the deviation configuration of FIG. 4 can be obtained. The controls of the solenoid valves allow the quantity of hydraulic fluid in the thrust chambers to be regulated.

To replenish the fluid in the thrust chamber which has lost some of its fluid through being in communication with the annular space, the solenoid valve is opened (if it was closed) and plunger 19 or annular rod 20 of jack 1 is repositioned in order to admit the hydraulic fluid.

Rotation of tubular body 1 relative to the sleeve which is in contact with the wall is brought about by one or more blades or ribs 17, which prevents rotation of the sleeve, causes the pump to rotate, and hydraulic fluid to circulate.

Distribution of the hydraulic fluid first causes deployment of expansion means 16 until they press strongly on the wall of hole 13.

Continued pumping activates thrust jack 32 which exerts the weight on the tool required to continue drilling.

This force being taken up by the static friction of the pistons on the rock, all that need to done to prevent the tension of the rods from holding up drilling is to release them from the surface. Additional thrust can be obtained by releasing the rods still further from the surface in order to achieve compression at the upper end of the tubular body, where drill collars can also be located, although this is not absolutely necessary.

Figure 5:
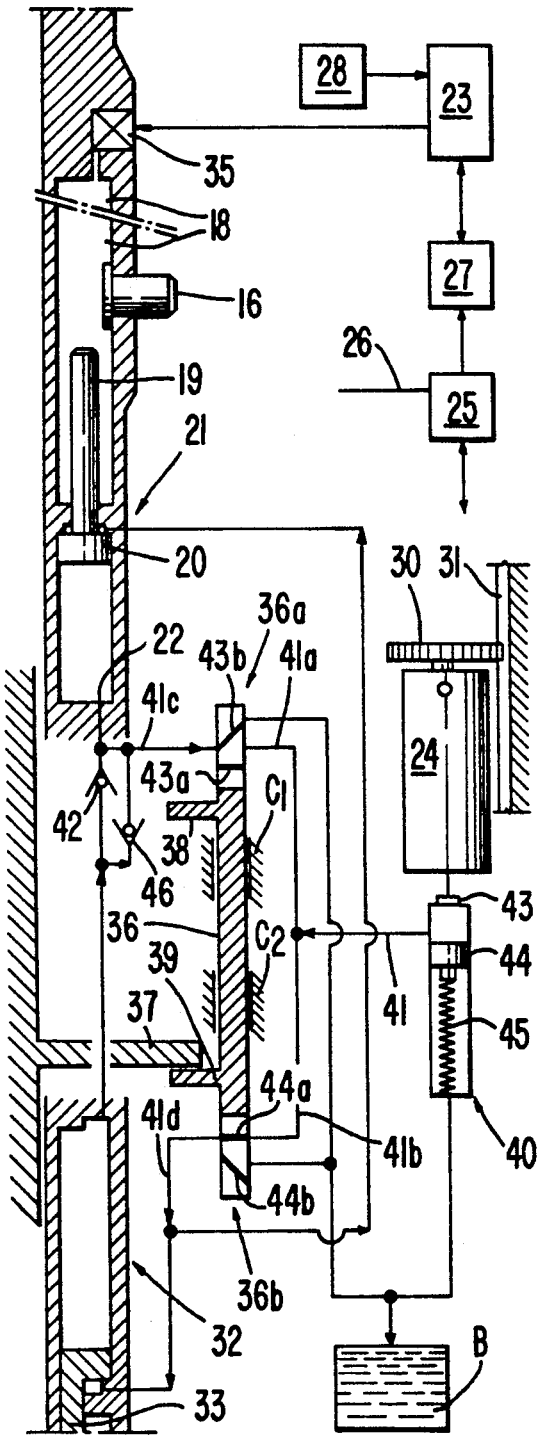
FIG. 5 shows schematically the means used to automate the anchoring and displacement cycles of the body relative to the outer sleeve, in a first position where, at the end of the jack extension phase, the control assembly ensures hydraulic switching for the return phase.
Figure 6:
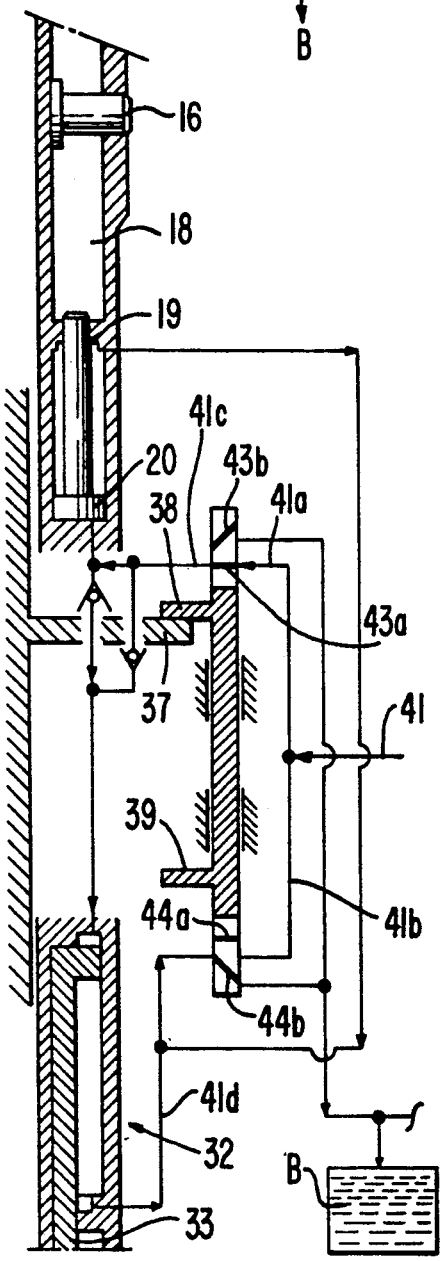
FIG. 6 shows schematically the same means at the end of a cycle where reverse switching occurs for a new automatic anchoring-extension cycle.
Figure 7:
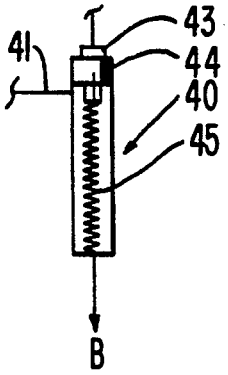
FIG. 7 shows schematically the action of a safety element used at the pump outlet.

The diagrams of FIGS. 5 to 7 show in greater detail the control assembly which automatically produces successive cycles of anchoring and the outer sleeve and sliding relative to this sleeve of the body and the associated drilling tool.

This control assembly, which is not shown in FIGS. 1 to 4 for reasons of clarity, comprises firstly an elongated slide 36 located in a cavity of outer sleeve 3 (see FIG. 1) in a direction substantially parallel to the axis of the device, whose opposite end parts 36A, 36B slide in a fluid-tight manner in two cylindrical cavities 37, 38 respectively, provided in outer sleeve 3 (see FIG. 1) between a first position (FIG. 6) and a second position (FIG. 5). Movable slide 36 is provided with two fixed stops 38, 39 at a distance apart. Displacement of movable slide 36 is achieved by the contract of a pin 37 integral with tubular body 1. The distance between the two stops 38, 39 is chosen according to the planned travel of body 1 relative to outer sleeve 3. The position of pin 37 relative to the two stops is chosen such that, in the vicinity of the retracted position of the drilling tool shown in FIG. 1, it presses on stop 37 and displaces movable slide 36 in the same direction. Likewise, the position of pin 37 is chosen so that, at the end of the extension movement of body 1 outside outer sleeve 3 (movement in the direction opposite the preceding movement) it bears against the other stop 39 and moves movable slide 36 in the same, opposite direction.

A safety element 40 is connected to the outlet of hydraulic pump 24. When pump 24 is made to rotate by rotation of body 1 relative to outer sleeve 3 and delivers fluid under pressure, safety element 40 causes the outlet of pump 24 to communicate with two branches of circuit 41A, 41B terminating in the two cavities 37, 38 respectively. A third branch of circuit **41*c* leaves cavity 37, communicating with a first end of the chamber of each anchoring jack 21 and with a first end of the chamber of annular sliding jack 32 via a calibrated valve 42. A second branch of circuit 41*d* leaves cavity C2 and communicates with a second end of the chamber of each anchoring jack 21 and also with the chamber of sliding jack 32**.

Two channels **43*a*, 43*b* on the one hand and 44*a*, 44*b* on the other hand traverse respectively the opposite end parts of slide 36 sliding in the two cavities C1, C2. In the first position of the slide, branches 41*b* and 41*d* communicate by channel 44*b***.

The opposite end parts of the two cavities C1, C2 communicate with the space (note B in FIGS. 5 to 6) between body 1 and outer sleeve 3 (see FIG. 1) which is filled with fluid at the inlet pressure of pump 24. This space is symbolized by a box B in FIGS. 5 and 6.

In the first position of slide 36, branch **41*d* communicates with space B. In the second position of slide 36, branch 41*c*** communicates with space B.

Calibrated valve 42 is used as a hydraulic delay means in order for the extension of anchoring jacks 16 (FIG. 1) to be effective before the sliding movement of body 1 and the drilling tool out of outer sleeve 3.

Safety element 40 has a cylinder 43 in which a piston 44 slides in a fluid-tight manner under the antagonistic actions of the pressurized fluid from the outlet of pump 24 and a spring 45. The tension of spring 45 is regulated such that, at the normal rotational speed of pump 24, the pump outlet communicates with branches **41*a*, 41*b*** of the hydraulic circuit.

When pump 34 is no longer driven, retraction of piston 44 is sufficient to place branches **41*a*, 41*b* in communication with space B at the lowest pressure of the circuit (FIG. 7). A check valve 46 is connected in parallel with calibrated valve 42**.

The control assembly operates as follows. As soon as the slide has been pushed by pin 37 resting on stop 38 into the position shown in FIG. 6, the pressurized fluid leaving pump 24 is applied by channel **43*a* and branch 41 to anchoring jacks 21 which has the effect of pushing plungers 19 into thrust chambers 18 (see FIG. 1A) and consequently pushing pistons 16 into their anchoring positions in the well wall and immobilizing outer sleeve 3. With some lag relative to pistons 16 because of calibrated valve 42, the pressurized fluid penetrating jack 32 has the effect of pushing the body into its extended position relative to the outside of sleeve 3. The fluid in branches 41*d* and channel 44*b*** returns to space B.

At the end of its travel, pin 37 bears on opposite stop 37 and moves slide 36 into the position shown in FIG. 5.

Branch 41 of the circuit is now placed in communication with channel **44*a*, branch 41*b* and the outlet of pump 24 and branch 41*c* which is placed in communication with space B via channel 43*b*. The pressurized fluid then has the effect of withdrawing plungers 19 from thrust chambers 18 and causing anchoring pistons 16 to retract. At the same time, the pressurized fluid applied to the piston of jack 32 has the effect of bringing it into its retracted position (FIG. 6) in which pin 37 once again moves slide 36**. A new anchoring/extension cycle begins automatically.

I claim:

1. A device connected between a drilling tool and a drilling system connecting said tool to a surface facility, to exert a hydraulic thrust on the drilling tool, the device having a tubular body integral with the system, a sleeve outside the tubular body able to rotate relative to said body and being longitudinally displaceable relative thereto, coupling means which can be displaced radially between a resting position in which they do not contact the wall of the well drilled by the tool, and a coupling position in which they are applied against the wall and immobilize said outer sleeve, and a hydraulic system having drive means to move said coupling means between their resting and their coupling positions, pushing means to move said body longitudinally relative to said outer sleeve in order to exert a pushing force on the drilling tool, and pumping means driven by the rotation of the body relative to said outer sleeve, characterized by the hydraulic system having hydraulic circuits isolated from the well, containing a fluid and connecting pumping means to said pushing means and said drive means, means for varying the fluid pressure in the circuits according to the hydrostatic pressure in the well, and a control assembly which can automatically carry out a succession of cycles each consisting of immobilizing the outer sleeve relative to the well by moving coupling means into their coupling positions, moving the drilling tool relative to the outer sleeve by acting on said pushing means, from a first retracted position to a second extended position, and displacement in the reverse direction to return the outer sleeve and the body to their original positions relative to each other.

2. A device according to claim 1 characterized by the control assembly having hydraulic return means to return the outer sleeve and the body to their original positions relative to each other.

3. A device according to claim 2 characterized by the control assembly also having second return means different from said hydraulic means.

4. A device according to claim 2 or 3 characterized by the coupling means having several expansible elements disposed radially at the periphery of outer sleeve and engaged respectively inside a thrust chamber, the drive means having elements displaceable in said chambers to cause their volume to vary, pushing means having at least one hydraulic jack, and the control assembly having a distributor cooperating with circuits and able to switch from a first state in which the pressurized fluid delivered by pumping means is directed to the thrust chambers and to said jack, in order to displace the expansible elements into their coupling positions with the well wall and to bring the body into the second extended position relative to said outer sleeve, and a second state in which the pressurized fluid is directed to thrust chambers and to jack to cause expansible elements to return to their resting positions and move body to its retracted position relative to outer sleeve.

5. A device according to claim 4 characterized by said elements displaceable in the thrust chambers having several rods integral with an annular crown surrounding said body and displaceable in an annular chamber communicating with pumping means by means of the control assembly.

6. A device according to claim 5 characterized by the hydraulic system having control means for selectively controlling communications between said thrust chambers and pumping means in order selectively to command displacement of coupling means to their respective coupling positions and angularly displace the axis of outer sleeve.

7. A device according to one of claims 1 to 3 characterized by having several coupling means assemblies located around the outer sleeve at several separate locations along said sleeve.

8. A device according to one of claims 1 to 3 characterized by the hydraulic system having hydraulic delay means allowing the expansible elements to be activated before said jack.

9. A device according to one of claims 1 to 3 characterized by the hydraulic system having safety means to lower the pressure in hydraulic circuits when pumping means are not driven.

10. A device according to one of claims 1 to 3 characterized by the control assembly having an electronic assembly connected to a surface facility and allowing the commands to be transmitted directly by an operator.

11. A device according to claim 6 characterized by said control means being connected to the control assembly.

12. A device according to claim 1 characterized by the means for causing the fluid pressure to vary in the circuits as a function of hydrostatic pressure comprising a piston which is displaceable freely and in a fluid-tight manner in a chamber to separate the hydraulic fluid from the external environment.

13. A device according to claim 12 characterized by said means for varying the fluid pressure also comprising elastic return means.

14. A device according to one of claims 1 to 3 characterized by comprising measuring assemblies.

* * * * *